US005972475A

United States Patent [19]

Beekman

[11] Patent Number: 5,972,475

[45] Date of Patent: Oct. 26, 1999

[54] STRUCTURAL SHEET DESIGN FOR REDUCED WEIGHT AND INCREASED RIGIDITY

[75] Inventor: Arie W. Beekman, Hoek, Netherlands

[73] Assignee: The Dow Chemical Company, Midland, Mich.

[21] Appl. No.: 08/957,598

[22] Filed: Oct. 24, 1997

[51] Int. Cl.[6] ..... B32B 3/28

[52] U.S. Cl. ..... 428/167; 428/120; 428/178; 428/188; 52/793.1

[58] Field of Search ..... 428/166, 178, 428/120, 167, 212, 218, 188; 52/793.1

[56] References Cited

U.S. PATENT DOCUMENTS

| | | | |
|---|---|---|---|
| 3,935,357 | 1/1976 | Padovani | 428/166 |
| 5,294,472 | 3/1994 | Arnold et al. | 428/178 |
| 5,348,790 | 9/1994 | Ben-Zvi et al. | 428/178 |

FOREIGN PATENT DOCUMENTS

| | | |
|---|---|---|
| 2032257 | 6/1991 | Canada . |
| 050462 | 4/1982 | European Pat. Off. . |
| 054856 | 6/1982 | European Pat. Off. . |
| 110221 | 6/1984 | European Pat. Off. . |
| 283071 | 9/1988 | European Pat. Off. . |
| 286003 | 10/1988 | European Pat. Off. . |
| 381339 | 8/1990 | European Pat. Off. . |
| 530545 | 10/1994 | European Pat. Off. . |
| 684352 | 11/1995 | European Pat. Off. . |
| 731233 | 9/1996 | European Pat. Off. . |
| 2508555 | 6/1982 | France . |
| 1504800 | 10/1969 | Germany . |
| 1609777 | 4/1970 | Germany . |

*Primary Examiner*—Donald Loney

[57] ABSTRACT

Improved extruded synthetic polymer resin sheet structures are disclosed having optimized combinations of rigidity, light transmission, thermal insulation and sheet weight per unit surface area. These improved structures have rib structures where the shear modulus equivalent value ("G") is optimized and is in the range of from about 0.5 to less than about 8. In one embodiment, an average of from one to nine rectangular cells per every ten cells contain a diagonal rib. In a preferred embodiment there are two crossing diagonals located in alternating rectangular cells. The reduction in the number of diagonal ribs reduces the weight of the sheet (per unit surface area) but surprisingly does not cause a proportional reduction in the sheet strength and rigidity.

16 Claims, 5 Drawing Sheets

STRUCTURAL SHEET DESIGN FOR REDUCED WEIGHT AND INCREASED RIGIDITY

Various types of extruded sheet structures prepared from thermoplastic resins are generally known and commercially available. Transparent or translucent structures are frequently desired and are known to be prepared from thermoplastic resins having the necessary degree of light transmission, such as polycarbonate or acrylic resins. One commercially available type of sheet is referred to as "twin wall" sheet or "structural" sheet and an example of this type of sheet is shown in FIG. 2. In this structure the two or more horizontal layers or faces (sometimes referred to as "walls") are spaced apart from each other by the rib or strut structures that determine the thickness dimension of the sheet. The ribs are also sometimes referred to as "webs" or "slats". The known and commercially available structures of this type have perpendicular ribs, diagonal ribs or certain combinations of perpendicular and diagonal ribs between and separating the parallel faces.

When viewed in cross-section along the direction of extrusion, two adjacent perpendicular or vertical ribs create square or rectangular spaces between the generally parallel horizontal faces. Perpendicular ribs provide very good mechanical and physical properties against compression and against forces applied in series in the direction parallel to extrusion. It is known, however, that such sheet structures can be very flexible if forces are applied across or perpendicular to the lines of extrusion as shown in FIG. 6*a*. FIG. 6*a* shows two supports (62) positioned in line across or perpendicular to the direction of extrusion and a force or load applied to the sheet surface at a point between the two supports. With only the perpendicular ribs, there is an undesirable amount of flex in the direction shown by "y" when such a force is applied.

Two adjacent diagonal or angled ribs, on the other hand, when similarly viewed in cross-section along the direction of extrusion, create triangular or trapezoidal spaces between the generally parallel faces (and perpendicular ribs, if present). See for example, EP-A-0 054 856, EP-A-0 530 545 and EP 0 731 233. The use of diagonal ribs gives improved rigidity and torsional strength in the perpendicular direction but adds weight and increases resin cost per unit sheet area.

Sheet structures of this type are being used in an increasing range of applications in commercial and residential construction in view of the good balances of physical properties, light transmission and thermal insulation. The different types of applications have differing demands insofar as the necessary sheet properties. The sheet can be used in horizontal or slightly sloping installations such as skylights or in vertical or steeply sloping installations. In these situations the sheet may be subjected to loads of snow and ice or to wind and suction forces in more that one direction.

It is therefore desired to provide extruded thermoplastic sheet structures having improved combinations of mechanical properties, thermal insulation and light weight.

SUMMARY OF THE INVENTION

The present invention provides an extruded thermoplastic resin sheet structure which comprises:(a) at least two generally parallel walls that are separated apart from one another and (b) perpendicular and diagonal ribs extending the length of the sheet in the direction of extrusion and separating the walls from each other, which sheet structure is characterized in that the shear modulus equivalent ("G" value, as defined below) is in the range of from about 0.5 to less than about 8 $N/mm^2$ and is preferably in the range of from about 0.5 to less than about 8 when tested on both surfaces of the structure In an a preferred embodiment, the sheet structure according to present invention has a "G" value greater than about 1. In an alternative embodiment, the sheet structure according to the invention has perpendicular ribs form repeating rectangular shaped cells along the direction of extrusion and an average of from one to nine rectangular cells per every ten cells contain at least one diagonal rib and more preferably, from two to eight cells per every ten cells contain at least one diagonal rib. In these structures it has been found advantageous for the cells containing a diagonal rib to each contain two crossing diagonal ribs.

It has been found that the thermoplastic resin is preferably selected from the group consisting of polycarbonate (PC), polypropylene (PP), poly(ethylene-terephthalate) (PET), glycol-modified PET (PETG) and polyvinyl chloride (PVC) and most preferably is polycarbonate (PC).

It has surprisingly been found that the structures having optimized "G" values and particularly when using the optimized rib structures having the preferred ratios of cells having ribs, provide desired levels of performance in lower weight and reduced cost structures.

DETAILED DESCRIPTION

Figure 2:
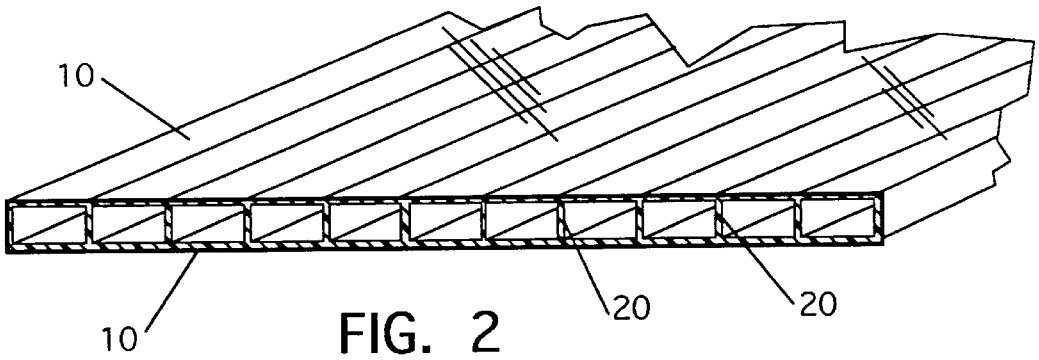
FIG. 2 represents a cross-sectional view along the direction of extrusion of a sheet structure according to the prior art where there are only perpendicular ribs.

When a multi-wall sheet is viewed in cross-section (cut across or perpendicular to the plane of extrusion as shown in FIG. 2) with the sheet flat and having the longest dimensions (length and width) in the horizontal plane, there are two or more generally parallel, horizontal walls, also referred to as layers or faces (10) and a series of upright or vertical ribs (20) that run between layers along the length direction and separate the layers. These ribs (20) are also sometimes referred to as "webs" or "slats". The known and commercially available structures of this type having rib structures shown in FIGS. 3*a* through 3*e* can be seen to have perpendicular ribs (21) or certain combinations of perpendicular ribs and diagonal ribs (22) between and separating the parallel faces.

Figure 1:
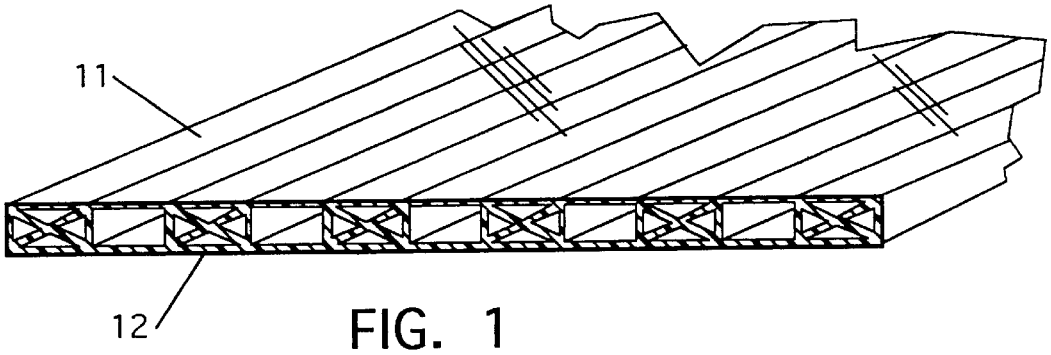
FIG. 1 represents a cross-sectional view along the direction of extrusion of a sheet according to the present invention where there is an optimized combination of perpendicular and diagonal ribs.

As illustrated in FIG. 1, these sheet structures usually have generally smooth external horizontal surfaces shown as 11 (upper surface) and 12 (lower surface) but can also have surface modifications, if desired. These sheet structures can also have more than two layers and are collectively referred to below generally as "multi-wall" sheet. For example, as shown in FIGS. 3E and 3F, in the case of three horizontal layers (referred to as "triple wall" sheet), there are two external layers (11 and 12) and one internal layer (13). Depending upon the thermoplastic resin used and design of the sheet structure, these twin- and multi-wall sheet structures offer good combinations of light transmission, thermal insulation, and physical and mechanical properties.

As mentioned above, FIG. 2 shows a cross-sectional view of a commercially available twin wall sheet structure without diagonals representative of FR 2,508,555 and EP 110,221. Similar multi-wall versions are also available as described in EP 684,352 and EP 286,003.

Figure 3A:
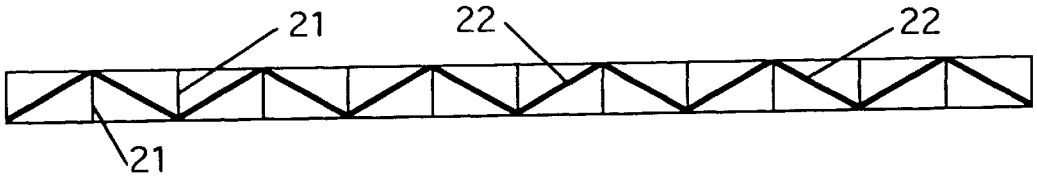
FIGS. 3A through 3F represent the rib structures of various prior art multi-wall sheet structures.

FIG. 3A shows the rib structure of a commercially available structure representative of EP 530,545. When loaded by wind or snow, alternating (odd) cell diagonals are compressed and every other (even) diagonal is in tension. Each cell has a diagonal and all are thick enough to be stable when compressed.

Figure 3B:
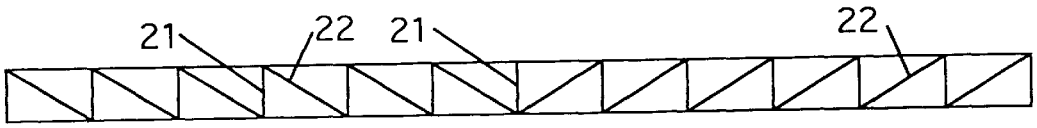

FIG. 3B shows the cross-sectional rib structure of a commercially available twin wall structure that is mirrored at center of panel. This structure is very rigid but only in one load direction.

Figure 3C:
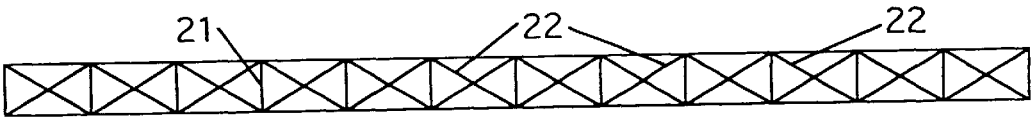

FIG. 3C shows the cross-sectional rib structure of a commercially available twin wall sheet structure having a very stable structure independent of load direction due to full length crossing diagonals in each cell.

Figure 3D:
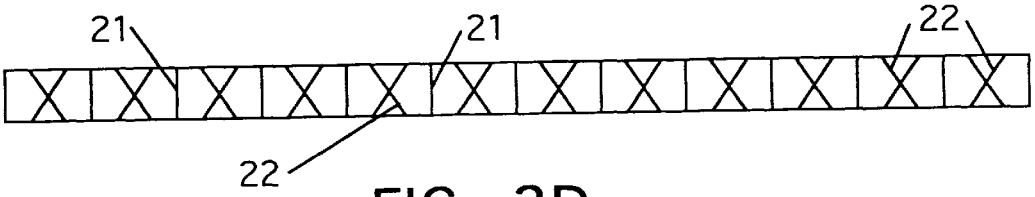
Figure 3E:
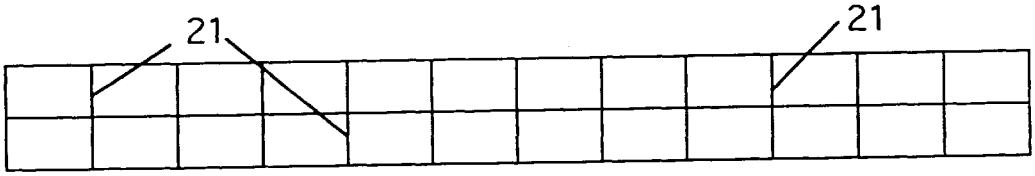
Figure 3F:
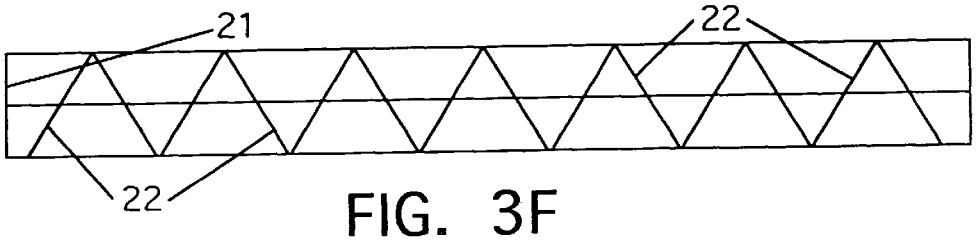

FIG. 3D shows the cross-sectional rib structure of a commercially available twin wall sheet structure having a stable structure independent of load direction, but lower weight per unit of surface area due to the shorter diagonals.

FIGS. 3E and 3F show the cross-sectional rib structures of triple wall sheet structures.

Upon evaluation of perpendicular rigidity of these and other sheet structures currently known and available it was generally found that modifications of the structures according to the invention could provide improved combinations of sheet performance and cost by optimizing the number and/or thickness of diagonal ribs in the structure.

FIG. 1 shows an improved sheet cross-sectional structure according to the invention where half of the cells (an average of five cells per every ten) have two crossing diagonal ribs.

Figure 4A:
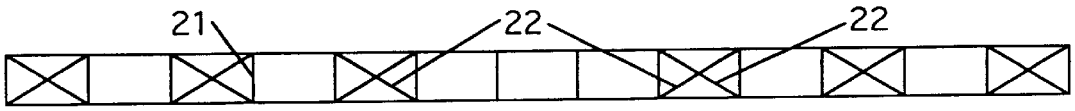
FIGS. 4A and 4B represent the rib structures of two alternative embodiments of structures according to the present invention where there are optimized combinations of perpendicular and diagonal ribs.

FIG. 4A shows the rib structure of an improved sheet cross-sectional structure according to the invention similar to that in FIG. 1 where nearly half of the cells have two crossing diagonals but sheet weight and cost are further reduced by using a center section without diagonal ribs.

Figure 4B:
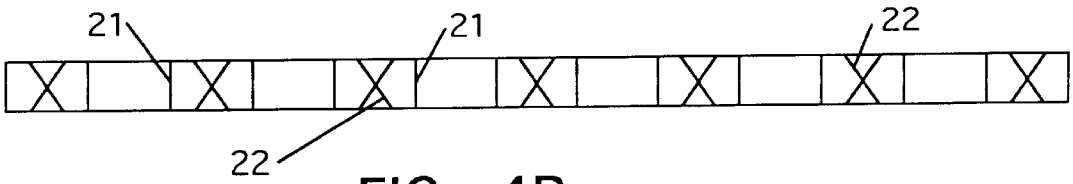

FIG. 4B shows an improved sheet cross-sectional structure according to the invention similar to that in FIG. 1 where half of the cells have crossing diagonals but weight is further reduced by using shorter diagonal ribs.

The key aspect of this invention is the surprising discovery that obtaining an optimized rib structure, such as by reducing the numbers of repeating rectangular units (referred to "cells") having diagonal ribs, did not cause a directly proportional reduction in sheet strength as compared to the amount by which the rib weight was reduced. Conversely, adding diagonal ribs to a percentage of the rectangular cells in prior art structures having no diagonals gave a surprising improvement in sheet performance.

In the prior art where diagonal ribs were used, it was taught to position diagonal ribs in each rectangular repeating unit to provide significant perpendicular rigidity. In contrast, as will be shown in more detail below, it has been found that removing the diagonal ribs from half of the cells of prior art structures reduces the weight of the diagonals per unit area by 50% but only reduced the perpendicular rigidity by 10%. Therefore, it is possible to provide a sheet structure with a high level of strength and insulation properties and reduce the sheet weight. This balance of strength improvement and weight reduction then minimizes the amount (cost) of supporting structural elements needed to install and support a given unit of sheet surface, reducing overall construction costs.

Figure 6A:
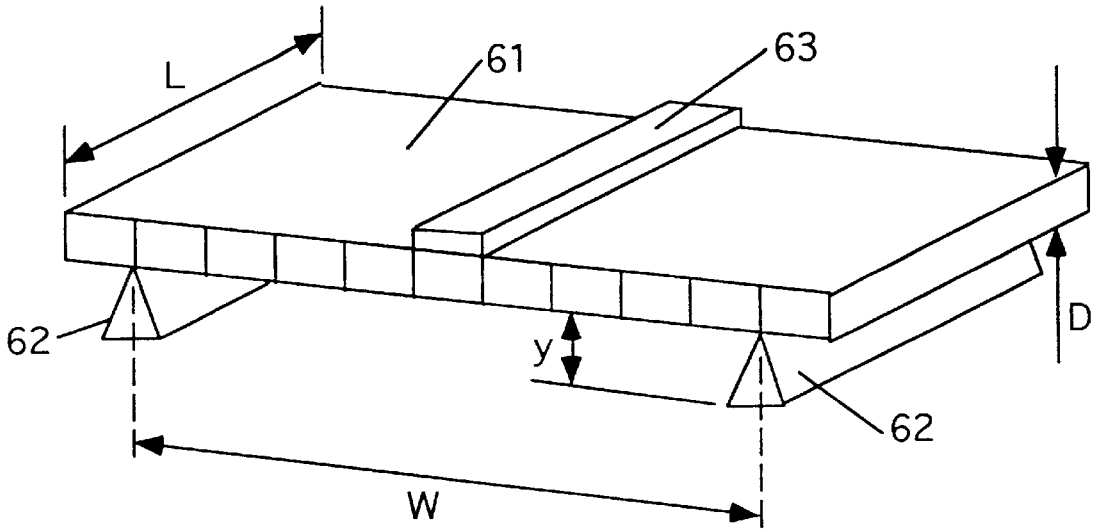
FIG. 6A shows a general experimental situation where a sheet structure is tested for its shear modulus equivalent value (resistance to flexing) in the direction perpendicular to the extrusion direction.

In order to determine the optimized rib structure (size, shape, location and number of ribs) for a particular set of sheet dimensions, it is useful to determine the effect that the rib structure plays in the perpendicular rigidity of the sheet (in the direction perpendicular to extrusion and rib direction). This is the resistance to flexing or bending under a central load when the sheet is supported on the two edges or edge points on opposite sides of the sheet cross section (see FIG. 6A). This can be measured or shown for a given structure when a piece of sheet is supported on two sides perpendicular or transverse to the direction of extrusion and loaded from above as shown in FIG. 6A. As can be seen, the sheet structure that is tested in this fashion flexes or is displaced a given amount "Y" in the vertical direction.

The maximum displacement of a "sandwich-type" sheet structure under a load as shown in FIG. 6A is calculated from the formula given in '*Roarks Formulas For Stress And Strain*', page 202. This formula is based on a sandwich-type structure where there is a foam material having a shear modulus of "G" in the center. This formula can also be applied where there is a rib structure in the center area of a multi-wall sheet to calculate an effective "G" value or shear modulus equivalent for a particular rib structure in the direction perpendicular to extrusion.

Using the above formula and performing an experiment as shown in FIG. 6A, "G" (in Newtons per square millimeter or $N/mm^2$) can be measured for a given sheet structure in the direction perpendicular to extrusion. The length 'L' of the sample should be 100–200 millimeters (mm). The sheet (61) is supported on two supports (62) located at the two edges on opposite sides of the sheet cross section. The force 'F' should be applied to the sheet via a rigid strip of material (63) such as a metal strip and the force should be sufficient such that a displacement 'Y' is achieved of about 20 mm.

Figure 6B:
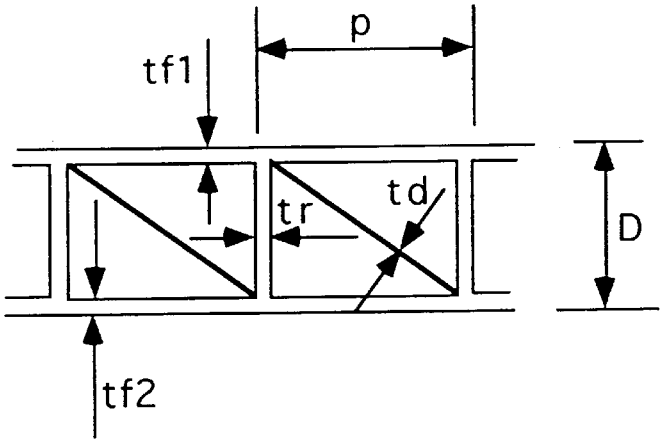
FIG. 6B illustrates the various dimensional variables in a multi-wall sheet structure.

As used herein and in this situation as shown in FIG. 6A, the formula which can be used to calculate the shear modulus equivalent for a given sheet structure in $N/mm^2$ in the direction perpendicular to extrusion, hereinafter referred to as "G" or the "G value", is:

$$y := \frac{1}{24} \cdot \frac{F \cdot W^3}{E \cdot D^2 \cdot tf \cdot L} + \frac{F \cdot W}{4 \cdot G \cdot D \cdot L}$$

where E is the material tensile modulus according to ISO 527 and the dimensions and other values needed for this calculation are shown in FIG. 6A or 6B. The ribs and walls are generally represented in more detail in FIG. 6B showing the dimensions needed to perform the calculations. The value to be used for the wall thickness (tf) should be obtained by averaging a number of values for tf1 and tf2 measured and averaged at different locations across the sheet width (W). All dimensions are in Newtons (N) and millimeters (mm).

Figure 7:
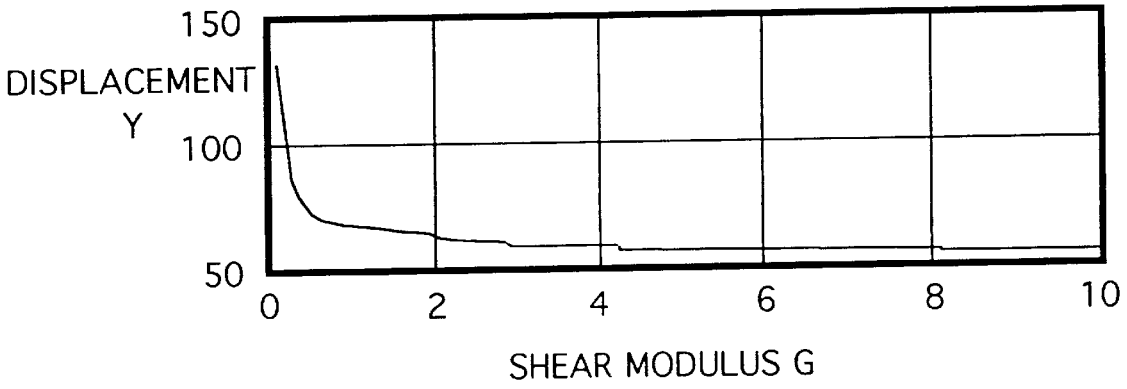
FIG. 7 is a graphical illustration of the relationship between the shear modulus equivalent value for a sheet structure and the resulting displacement distance under a given force.

By varying the rib structures, observing or calculating the "G" values and plotting the corresponding displacements (y values) that result (graphically shown in FIG. 7), it is found that displacement reaches a minimum (sheet rigidity is maximized) for sheet structures of this type as "G" values increase above about 0.5, more preferably above about 0.8 and most preferably above about 1. In general, as can be seen in FIG. 7, for "G" values exceeding about 5, and particularly those exceeding about 8, there is very little added rigidity.

Therefore, by providing a "G" value for the structure of at least about 0.5, preferably at least about 0.6, more preferably at least about 0.8 and most preferably at least about 1 optimized property combinations are obtained. Obviously, in sheet structures where G is unnecessarily high, these structures can be further optimized in terms of cost and performance by reducing the G value to less than about 8, preferably less than about 7, more preferably less than about 5, and most preferably less than about 4. This optimization can be done by a number of means including reducing the number or thickness of the diagonal ribs.

The sheet structures according to the present invention are unique and different in that the previously known sheet structures all had "G" values that were either higher or lower. On the low end, the prior art structures having only vertical ribs have poor rigidity and have "G" values on the order of about 0.3 or less. On the higher end, prior art structures having full length and/or thick diagonals in each rectangular repeating unit have good rigidity ("G" above about 8) but are relatively high cost and high weight.

It has been found that sheet structures according to this invention evidence only a minor reduction in overall rigidity when compared with the heavier, more expensive structure having a G of greater than 8. These sheet structure perform well in applications where sheet is only supported along edges parallel to the extrusion direction or where panel length exceeds 2 times the panel width, as is the case in most industrial glazing applications.

Sheet Dimensions

This invention can be applied to multi-wall or structural sheet structures across a very broad range of sheet dimensions and designs. Depending upon the polymer resin used and the intended application for the sheet, the sheet can range in total thickness from 4 to 100 millimeters (mm), with preferred thicknesses being in the range of at least about 5 mm, and more preferably at least about 10 mm up to about 85 mm, more preferably up to about 60 mm, more preferably up to about 35 mm and most preferably up to about 25 mm. Sheet having a thickness of between 10 and 25 mm is a preferred embodiment of the structures according to the invention.

Based on current construction techniques and sheet extrusion equipment, the width of sheet structures according to the inventions should be as wide as practical for the intended design, preferably at least about 0.2 meter (m), more preferably at least about 0.3 m, more preferably at least about 0.4 m, more preferably at least about 0.5 m and most preferably at least about 0.6 m. Depending upon production equipment restrictions or other considerations, these sheet structures generally have widths of less than about 3 m, preferably less than about 2 m, more preferably less than about 1 m. Wider sheet dimensions can of course be extruded and trimmed to the desired widths.

Layer and Rib Spacing and Thickness

The layers and ribs of the multi-wall sheet structures according to the invention can have a broad range of independently selected thicknesses depending upon the desired overall sheet thickness, the type of polymer resin used, whether they are interior (e.g., in triple-wall sheet) or exterior layers and the intended application for the sheet. For the exterior layers or walls, shown as tf1 and tf2 in FIG. 6B, it has been found that the thickness should be at least about 0.1 mm, preferably at least about 0.2 mm, more preferably at least about 0.3 mm and most preferably at least about 0.4 mm. On the other hand, it has been found that layers need not be thicker than about 5 mm, and are preferably less than about 4 mm and more preferably less than about 3 mm thick. The interior or exterior location clearly affects the needed layer thickness. As mentioned below, interior layers in triple- (or greater) wall sheet are typically thinner than outside layers, generally on the order of 0.1 to 0.25 mm thick. In preferred sheet structures according to the present invention, the ratio of the average wall thickness (average of tf1 and tf2) to the overall sheet thickness (D) is preferably at least about 0.01:1 and preferably less than about 0.07:1.

It has been found that the ribs can also usually be somewhat thinner than the external layers, with the diagonal ribs generally being somewhat thinner than the perpendicular ribs. The rib thickness, shown as "tr" (perpendicular rib) and "td" (diagonal rib) in FIG. 6B, are desirably at least about 0.05 mm, preferably at least about 0.1 mm, preferably at least about 0.2 mm, and more preferably at least about 0.3 mm and are preferably not thicker than about 3 mm, and are preferably less than about 2 mm thick.

As mentioned above, the repeating structural units in the sheet structures according to the invention are the rectangular units (also referred to as "cells") defined by repeating vertical ribs that are perpendicular to the walls (horizontal sheet layers). Although it is not essential, for aesthetic and installation purposes, it is preferable for the ribs to be symmetrically located across the width of the sheet and for the vertical ribs to be evenly and uniformly spaced apart. In the sheet structures according to the present invention it has been found that the distance between the perpendicular ribs ("p" in FIG. 6B) is desirably related to the thickness of the perpendicular ribs "tr". In general, the ratio tr:p is desirably at least about 0.01:1 and preferably less than about 0.07:1.

The size of repeating rectangular units is selected based on desired level of sheet performance (e.g., G value), smaller repeating units providing stronger, more rigid sheet but increasing sheet weight. In the structures according to the present invention, it has been found that the average distance between perpendicular ribs, i.e., the average width of individual cells shown as "p" in FIG. 6B, is also related to the overall sheet thickness for optimized rib structures. In general, it is preferred to have a relationship where the ratio of the average individual cell width (p) to the overall sheet thickness (D) is at least about 0.4:1, more preferably about 0.8:1 and is preferably less than about 2:1, more preferably less than about 1.2:1. For different sheet types and thicknesses, p, the distance between ribs, and rib height, D−(tf1+tf2) can range from about 3 mm, preferably at least about 4 mm, more preferably at least about 5 up to about 50 mm, preferably less than about 40 mm, more preferably less than about 30 mm and most preferably less than about 20 mm.

Based upon selection of the desired overall sheet thickness, the number of walls (i.e., layers or faces) and the spacing between walls or layers (height of the perpendicular ribs) can be selected accordingly to provide desired sheet performance properties. Preferably, in sheet thicknesses up to about 20 mm, two or three spaced apart layers are employed (i.e., twin- or triple-wall sheet). If three layers are used (upper, center and lower layers) the center layer can be located an equal distance from the upper and lower layers (centered) or somewhat closer to one surface or the other.

EP 286 003 and EP 731 233 discuss the use and location of three or more layers in the multi-layer sheet to optimize the thermal insulation and rigidity properties. EP 731 233 further discusses the desirability of providing the distance between the layers such that cells with laminar airflow behavior are created. This is obtained, for instance, when the vertical distance between two layer in the disclosed structures was approximately 14 mm. In this case, a cell geometry is obtained in which the air is free of turbulence, thus achieving an optimum thermal insulation effect.

EP 731 233 further discusses the desirability of providing a central layer which is thinner than the outside layers. It was taught that the central layer contributes little, if anything, to the overall rigidity of the board and the main function was to provide cell dimensions for the appropriate airflow behavior for optimized thermal insulation. In addition, the central layer has the function of an additional heat transfer obstacle, which further improves thermal insulation. In general overall sheet thicknesses on the order of 10 mm are 'twin-wall' or have two layers and thickness on the order of 16 mm or more are triple or multiple wall with one or more interior layers or faces.

Diagonal Ribs

The use of diagonal ribs is recognized by the practitioner in this area to provide the sheet with improved torsional and perpendicular rigidity due to their rigidity in tension. The compressive strength of the ribs is not nearly as good, especially with thinner ribs. Therefore, a single diagonal provides tensile resistance against a torsional force from one direction but is compressed and more likely to fail if a torsional force is applied from other direction that puts a compressive force on that rib. Maximum sheet rigidity requires that the diagonal ribs be straight between intersection with the sheet walls or perpendicular ribs and that there be diagonal ribs extending in both directions so that there will always be tensile resistance against forces from different directions.

As mentioned above, however, the prior art sheet structures having diagonal ribs and perpendicular ribs were generally taught to have diagonal ribs (in one or both directions) in each repeating rectangular unit or cell. According to the present invention, it has been found that improved combinations of sheet performance and sheet cost/weight are obtained where, on the average, diagonal ribs are located in nine or less rectangular units per every ten rectangular units across the width of the sheet, preferably eight or less, more preferably seven or less and most preferably in six or less rectangular units per every ten. Preferably diagonal ribs are located in an average of at least one cell, more preferably at least two cells, more preferably in at least three and most preferably in at least four cells per every ten rectangular cells. In a preferred embodiment of the present invention, there are diagonal ribs located in alternating cells (i.e., diagonal ribs located in about five cells per every ten).

Preferably, the cells with diagonal ribs are located in a generally regular and symmetrical distribution or pattern across the width of the sheet to provide the best properties. It should be noted however, that the cell pattern should desirably be symmetrical around the center point of the sheet. It is possible, and in fact preferred, to have a somewhat higher concentration of cells with diagonals nearer the edges and a higher concentration of cells without diagonal in the center of the sheet.

The angle of the diagonals from the main horizontal wall and the location within a rectangular cell are selected to provide optimized combinations of sheet rigidity and shortest rib length (reduced sheet weight). The diagonal ribs may intersect the main layer(s) at the same points where the vertical ribs intersect or at different points. Intersection at the same point as the vertical ribs provides the best torsional or perpendicular sheet rigidity. However overall sheet stability, especially with respect to buckling in perpendicular direction, can be critical and limit panel load ability. Diagonal ribs that intersect the horizontal cell walls at different points inside the cell (other than where the perpendicular ribs intersect) will highly improve panel stability, but on cost of perpendicular and torsional rigidity.

In an alternative embodiment of the present invention, the cells having diagonals contain two crossing diagonals. Preferably, these crossing diagonals connect to the sheet layers at the intersection between horizontal layers and vertical ribs.

Types of Plastics

As recognized by the skilled practitioner, depending upon the need for rigidity, thermal insulation, light transmission, weathering resistance and ignition resistance, these types of structures can be prepared from a broad range of plastic resins. Desirably, these structures are prepared from one of the known rigid thermoplastic resins including poly(styrene-acrylonitrile (SAN), butadiene rubber modified SAN (ABS), poly(methyl-methacrylate) (PMMA), but are preferably prepared from polycarbonate (PC), polypropylene (PP), poly (ethylene-terephthalate) (PET), glycol-modified PET (PETG) or polyvinyl chloride (PVC). More preferably, the sheet structures are prepared from PC, PET or PETG, and are most preferably prepared from PC.

The structures according to the invention can also contain or have laminated or coextruded thereto further layers of other thermoplastic or thermoset resins to provided desired performance results, particularly where it is desired to modify the surface(s) of the sheet structures in some fashion, such as for abrasion/scratch resistance, chemical resistance, UV radiation resistance, or the like. The normal types of additives may be used for their known purposes for these plastic resins and structures, including but not limited to stabilizers, processing aids, fillers, reinforcing aids, colorants and the like. Such additives can be added to the polymer resins that are used to prepare these structures and/or to any layers that may be coextruded or laminated thereto for their known purposes.

EXAMPLE

Twin wall polycarbonate sheets having an overall sheet thickness of 10 mm but differing rib structures are used to make a skylight structure. The sheet structures are compared according to their ability to reduce the total cost of the skylight structure. An improved sheet structure provides a reduction in sheet cost/weight and/or a reduction in support materials due to the improved sheet rigidity.

Figure 5:
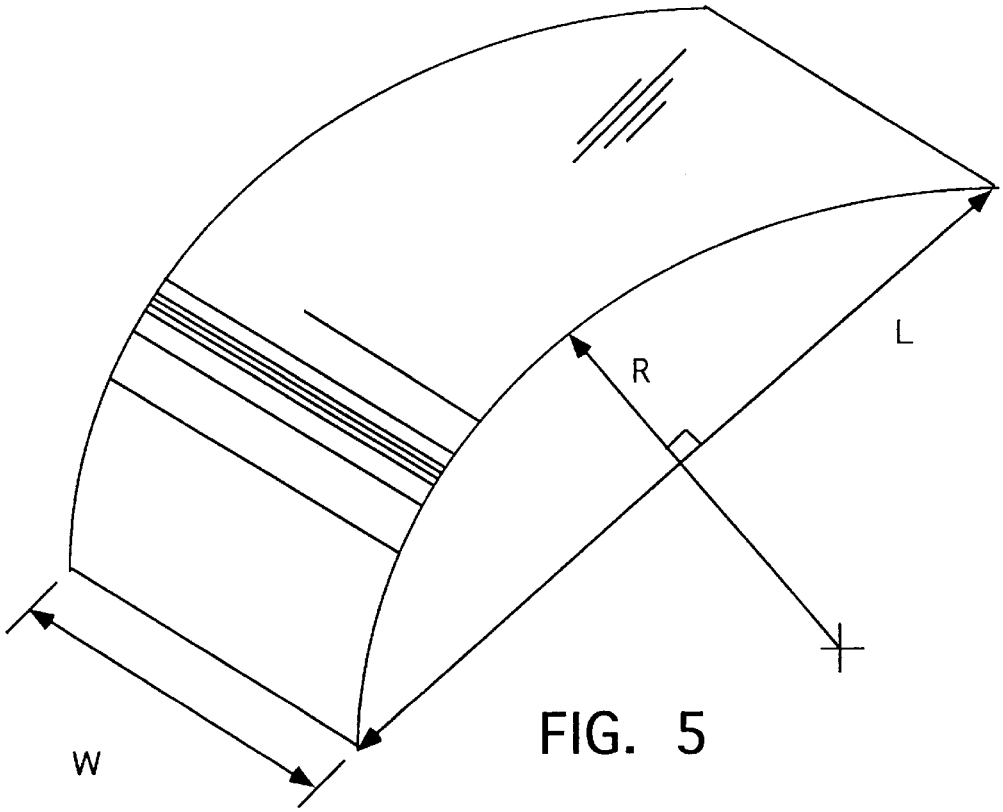
FIG. 5 is a diagram of an arched skylight structure that can be prepared using the improved sheet structures according to the invention.

The skylight structure, having an upward arched shape, is generally shown in FIG. 5. The skylight structure will be engineered to withstand a snow load of 0.9 kiloNewton per square meter ($kN/m^2$) and a wind suction load of 3 $kN/m^2$. The sky light arch radius will be 2.9 meters and the base length will be 4.4 meters (m). Sheets having lower levels of rigidity will be able to meet these requirements by decreasing the span distance and requiring more support structure hardware. Sheets with higher levels of rigidity may have longer span distances but may be heavier and therefore more expensive.

The comparative skylight structures are prepared from 10 mm thick twin wall panels having the structures shown in FIGS. 2 (prior art), 3C (prior art) and 1 (example of the invention). For the structures according to the present invention the specific panel weight is 1.9 kg/m$^2$, the wall thickness (average of tf1 and tf1 as shown in FIG. 6B) is about 0.5 mm, the vertical rib thickness (tr) is about 0.4 mm, the diagonal rib thickness (td) is about 0.15 mm, the distance between ribs (p) is about 10 mm, the "G" value is about 1 N/mm$^2$ and the skylight meets the performance requirements when the support distance ("W" in FIG. 5) is as wide as 725 mm. Standard 10 mm twin wall panels according to FIG. 2 (no diagonals) with weight of 1.7 kg/m$^2$, tr of about 0.4 mm, wall thickness of about 0.5 mm, p of about 10 mm and "G" value of about 0.3 N/mm$^2$ need a support every 500 mm. Panels according to FIG. 3C that contain thick diagonals in each cell also need a support every 725 mm but have a panel weight of 2.3[kg/m$^2$], tr of about 0.5 mm, td of about 0.4, wall thickness of about 0.5 mm, p of about 10 mm and "G" value greater than 10 N/mm$^2$.

It can therefore be seen that the sheet structure according to the present invention surprisingly maintains rigidity at lower cost/weight per unit surface area and will thereby reduce the overall skylight expense.

What is claimed is:

1. An extruded thermoplastic resin sheet structure which comprises:

(a) at least two generally parallel walls that are separated apart from one another and (b) perpendicular and diagonal ribs extending the length of the sheet in the direction of extrusion and separating the walls from each other, which sheet structure is characterized in that the shear modulus equivalent ("G" value) is in the range of from about 0.5 to about 5 N/mm$^2$.

2. A sheet structure according to claim 1 where the "G" value is greater than about 1.

3. A sheet structure according to claim 1 where perpendicular ribs form repeating rectangular shaped cells along the direction of extrusion and an average of from one to nine rectangular cells per every ten cells contain at least one diagonal rib.

4. An extruded sheet structure according to claim 3 wherein from two to eight cells per every ten cells contain at least one diagonal rib.

5. An extruded sheet according to claim 3 wherein the cells containing a diagonal rib each contain two crossing diagonal ribs.

6. A sheet structure according to claim 1 where the "G" value is in the range of from about 0.5 to about 5 when tested on both surfaces of the structure.

7. A sheet structure according to claim 1 where the thermoplastic resin is selected from the group consisting of polycarbonate (PC), polypropylene (PP), poly(ethylene-terephthalate) (PET), glycol-modified PET (PETG) and polyvinyl chloride (PVC).

8. A sheet structure according to claim 1 where the thermoplastic resin is polycarbonate (PC).

9. An extruded polymer resin sheet structure which comprises:

(a) at least two generally parallel walls that are separated apart from one another and (b) perpendicular and diagonal ribs extending the length of the sheet in the direction of extrusion and separating the walls from each other, which perpendicular ribs form repeating rectangular shaped cells along the direction of extrusion which sheet structure is characterized in that an average of from one to nine rectangular cells per every ten rectangular cells contain at least one diagonal rib which intersects the parallel walls at the same points where the vertical ribs intersect.

10. A sheet structure according to claim 9 wherein the shear modulus equivalent ("G" value) is in the range of from about 0.5 to less than about 8 N/mm$^2$.

11. A sheet structure according to claim 10 where the "G" value is greater than about 1.

12. A sheet structure according to claim 9 where an average of from two to eight cells per every ten cells contain at least one diagonal rib which intersects the parallel walls at the same points where the vertical ribs intersect.

13. An extruded sheet according to claim 9 wherein the cells containing a diagonal rib each contain two crossing diagonal ribs which intersect the parallel walls at the same points where the vertical ribs intersect.

14. A sheet structure according to claim 9 where the "G" value is in the range of from about 0.5 to less than about 8 when tested on both surfaces of the structure.

15. A sheet structure according to claim 9 where the thermoplastic resin is selected from the group consisting of polycarbonate (PC), polypropylene (PP), poly(ethylene-terephthalate) (PET), glycol-modified PET (PETG) and polyvinyl chloride (PVC).

16. A sheet structure according to claim 14 where the thermoplastic resin is polycarbonate (PC).

* * * * *